United States Patent [19]

Coulter

[11] Patent Number: 4,778,299

[45] Date of Patent: Oct. 18, 1988

[54] APPLICATION FOR CREASE SETTING COMPOSITION

[75] Inventor: John P. Coulter, Shipley, United Kingdom

[73] Assignees: Wool Development International Limited, West Yorkshire, United Kingdom; Dynic Corporation, Tokyo, Japan; a part interest to each

[21] Appl. No.: 924,197

[22] Filed: Oct. 28, 1986

[30] Foreign Application Priority Data

Oct. 29, 1985 [GB] United Kingdom ..... 8526656

[51] Int. Cl.[4] ..... A41D 1/10; B65D 88/54; B05C 13/02

[52] U.S. Cl. ..... 401/48; 401/176; 401/188 R; 401/190; 401/193; 68/200; 222/389; 118/710

[58] Field of Search ..... 401/48, 174, 176, 193, 401/188 R, 190; 222/389, 192, 387, 326, 386; 118/710, 410; 68/200; 251/319, 320

[56] References Cited

U.S. PATENT DOCUMENTS

| | | | |
|---|---|---|---|
| 3,687,102 | 8/1972 | Dunn | 118/710 |
| 3,813,012 | 5/1974 | Laird | 222/326 |
| 4,182,264 | 1/1980 | Gibson et al. | 401/48 X |
| 4,505,410 | 3/1985 | Coulter | 401/48 X |
| 4,508,245 | 4/1985 | Houlbrook et al. | 222/567 X |

*Primary Examiner*—Richard J. Apley
*Assistant Examiner*—Franklin Gubernick
*Attorney, Agent, or Firm*—Bert J. Lewen; Henry Sternberg

[57] ABSTRACT

An applicator 10 for crease setting composition comprises an applicator body 12 having at one end thereof a nozzle 14 for applying a crease setting composition to a crease line and at the other end thereof an inlet 26 for compressed air for forcing the composition out of the nozzle 14. Guidance projections 18, 42 are mounted beneath the body so as to guide the applicator nozzle 14 and cause it to deliver composition accurately into the crease. Guidance projections 18, 42 is operatively connected to a valve 2 in the compressed air circuit such that when the guidance projections 18, 42 contacts the garment to be treated pressure is applied to the composition and when the guidance projections are removed from the garment to be creased pressure is removed from the composition.

7 Claims, 2 Drawing Sheets

APPLICATION FOR CREASE SETTING COMPOSITION

Figure 1:
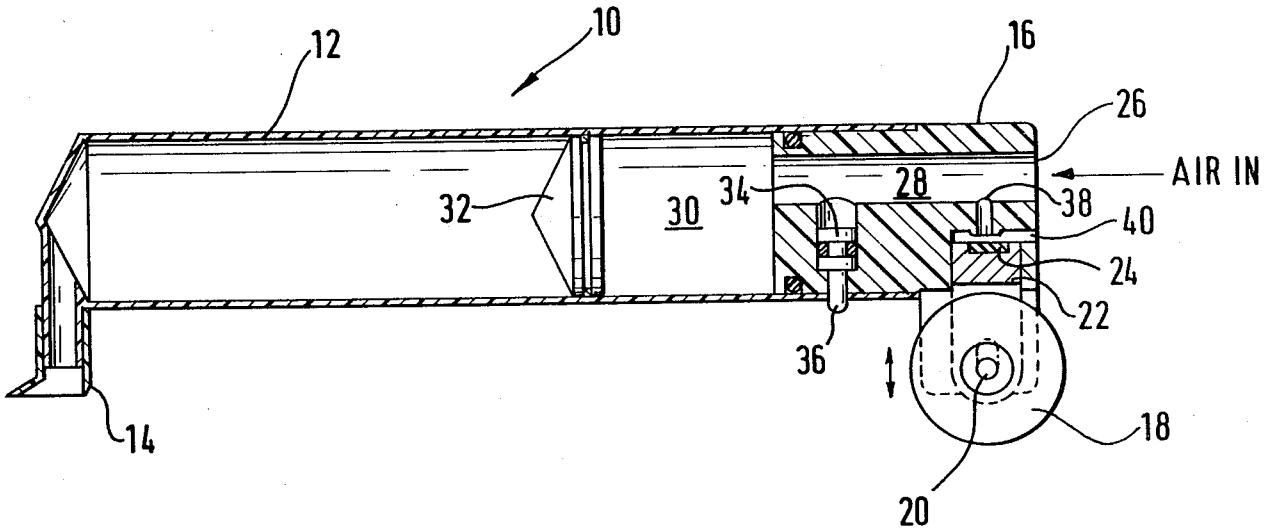

This invention relates to an applicator, particularly for the formation of durable creases by application of a crease setting composition.

In order to form durable creases in a textile article, for example in trousers or slacks, the setting composition may be introduced into the formed creases, example according to UK Pat. No. 1603252 or European published application No. 67528. The creases are made durable by curing the composition. In these specifications, the applicator is operated by hand, and has a nozzle on one end of a cylinder. The composition filling the cylinder is compressed by a piston within the cylinder, and is forced through the nozzle. The piston is moved by the rotation of a rotary member mounted on the lower portion of the other end of the cylinder in response to movement along the creased line.

Where trousers made of very lightweight material are to be treated, the normal creasing composition cannot be employed since its viscosity is such that, although perfectly satisfactory for normal to heavyweight materials it can "strike through" to the front surface of lightweight materials. Thus a different crease setting composition, or resin, has to be employed which will not strike through. Such a resin is available but has a higher viscosity than the normally used composition. This means that more effort is needed to expel it through the nozzle. Since the driving force is obtained by pressure of a rotary member on the fabric of the trousers this can cause the fabric to ruck up or otherwise distort, thereby destroying the precision necessary to produce an accurate crease line. UK published application No. 2158159 provides an applicator for crease setting composition which comprises an applicator body having at one end thereof a nozzle for applying the crease setting composition into a crease line and at the other end thereof an inlet for compressed air for forcing the composition out of the nozzle, and guidance means mounted beneath the body adapted, in use, to depend into the crease line so as to guide the applicator nozzle to cause it to deliver composition accurately into the crease. Thus, in this publication, the means of expelling the crease setting composition is compressed air and no driving force need be generated by contact of driving wheels with the garment to be crease stabilised. Although originally designed to cope with higher viscosity resins and/or lightweight garments, the system also has advantages when used with any garments and/or with the lower viscosity resins ordinarily employed.

The above system has certain advantages in practice but it is necessary for the operator to control the supply of compressed air to the applicator and to this end a switch is provided which the operator must use in conjunction with the movement of the applicator over the garment to be treated so as to turn on and off a solenoid valve controlling the supply of compressed air to the applicator. Thus the operator must control the operation of the applicator in relation to the garment and independently control the supply of compressed air using the switch provided.

The present invention seeks to provide an improved form of applicator in which the supply of compressed air is controlled automatically without there being need of a separate switch and associated electrical circuitry.

According to the present invention there is provided an applicator for crease setting composition which comprises an applicator body having at one end thereof a nozzle for applying a crease setting composition into a crease line, and at the other end thereof an inlet for compressed air for forcing the composition out of the nozzle, and guidance means mounted beneath the body so as to guide the applicator nozzle and cause it to deliver composition accurately into the crease, characterised in that the guidance means is operatively connected to a valve in the compressed air circuit such that when the guidance means contact the garment to be treated pressure is applied to the composition and when the guidance means are removed from the garment to be creased pressure is removed from the composition.

In one preferred embodiment the guidance means may be a pair of rollers or wheels similar to those on the device shown in European publication No. 67528. The guide wheels are mounted on an axle in a block mounted for reciprocation within the applicator body. The distal end of the block carries a valve for the compressed air. The valve may be in the inlet of compressed air or, preferrably, in a connection from the interior of the applicator body to a vent for compressed air.

When the applicator is placed on a garment to be treated the guide wheels contact the garment (or the support on which the garment is located) causing the block to move within its mounting and operate the compressed air valve thus causing pressure to be applied to the crease setting composition which will therefore be expelled from the nozzle. Removing the applicator from the garment has the opposite effect since the block will then, under the action of the compressed air, slide in the opposite direction thereby opening the valve and relieving the pressure from the composition.

Figure 2:
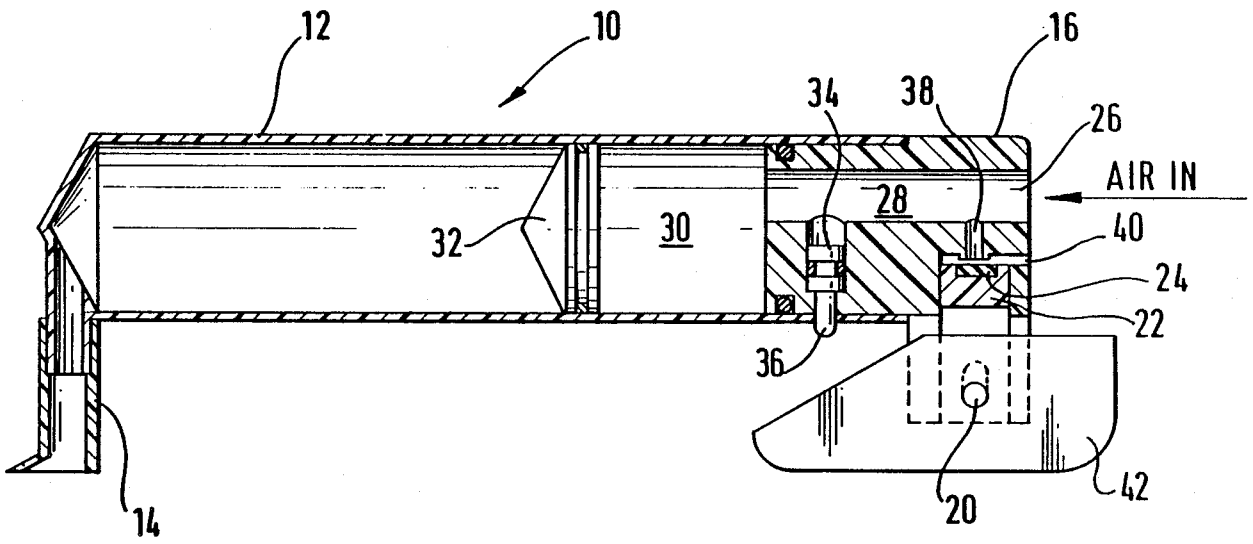

The invention will be described further, by way of example, with reference to the accompanying drawing, in which;

FIG. 1 is a sectional view of an embodiment of an applicator in accordance with the invention; and FIG. 2 is a similar view to FIG. 1 of another embodiment.

Referring to the drawings, and in particular FIG. 1, the applicator illustrated is in some respects similar to the applicator illustrated in FIG. 1 of European Pat. No. 67528 in that the applicator generally designated 10 comprises a reservoir 12 in the form of a moulded plastic cartridge body having a nozzle 14 which, in use, depends into the crease line of a garment being treated. The reservoir 12 may be in the form of a replaceable cartridge and contains a crease setting composition, for example a curable silicone rubber compound, or a curable polyurethane compound. The cartridge 12 is a slidable fit onto a shaped support block 16. The block 16 may be made from metal or, preferably, may be a plastics material moulding. Rotatable guide wheels 18 are mounted on an axle 20 held in a reciprocatable valve block 22. The block 22 is slidably mounted within the support block 16 and carries at its distal end a valve seat 24.

The block 16 has an inlet 26 for compressed air which may have a suitable coupling for a compressed air line, leading into a central chamber 28 within the block and communicating with the area 30 behind a plunger 32. It will be appreciated that the crease setting composition is to the left of the plunger 32 as illustrated in the drawing, and that air pressure applied within the space 30 causes the plunger 32 to move to the left and expel composition from the nozzle 14.

As mentioned above, the cartridge for reservoir 12 is a slidable fit on the support block 16. In order to locate and retain the cartridge and block 12, 16 together a further valve 34 is provided. This also operates under the pressure of compressed air within the chamber 28 and forces a spigot 36 downwardly through a corresponding hole in the cartridge 12 thereby retaining the cartridge 12 on the block 16. If desired another form of mechanical retention, for example a grubscrew, could be employed but the pneumatic valve arrangement is convenient in that once the air pressure has been released (when the applicator is no longer in use) it is a very simple matter for the operator to remove and replace a spent cartridge 12.

The valve seat 24 on the reciprocatable block 22 cooperates with a valve passage 38 leading to an air vent 40, and the block 22 can slide between a position where the passage 38 is shut off to a position (illustrated) where the passage 38 is in communication with the vent 40.

In use, the applicator 10 is connected to an air supply and compressed air is lead into the chamber 28. The pressure within the chamber 28 acting through the valve passage 38 forces downwardly the block 22 allowing the air to vent to atmosphere via the vent 40. Under these conditions there is insufficient pressure within the chamber 28 to force the plunger 32 along the cartridge and expel composition.

When the applicator is put in position on a garment to be creased and the guide wheels 18 brought into contact with the garment, or its support, sufficient pressure is applied (which need not be very great) to move the reciprocatable member 22 upwardly causing the valve seat 24 to engage the valve passage 38 and shut it off. The pressure within the chamber 28, and therefore behind the plunger 32, therefore rapidly rises expelling composition through the nozzle 14. The applicator is moved along the crease line depositing the expelled resin accurately in the crease after which the applicator is removed from the garment. At this point the pressure within the chamber 28 acting through the valve passage 38 forces the member 22 downwardly and allows the pressure once again to be vented via the vent 40. Thus at this point the composition ceases flowing through the nozzle 14.

The embodiment shown in FIG. 2 is generally the same as that shown in FIG. 1 and like numerals have been used for like parts. It differs in that the guidance means, instead of being wheels 18, comprise a blade or fin 42. The latter locates within the crease line of the garment being treated and accurately guides the applicator so that the nozzle 14 deposits a precise line of setting composition within the crease. The block 22 operates as described above.

The apparatus of the invention provides a simple and elegant means of ensuring automatic control of the application of resin without requiring the operator independently to control the compressed air supply. With the present invention the compressed air supply is left on and bringing the applicator to the garment ensures that composition is expelled exactly for the period when it is required and is shut off again when it is not required. The associated switch and electrical system including the solenoid may therefore be dipensed with leading to economies as well as more accurate control. Since the composition is turned off and on precisely when required savings in resin are made and more garments per cartridge may be treated.

What is claimed is:

1. An applicator for crease setting composition which comprises an applicator body having at one end thereof a nozzle for applying a crease setting composition into a crease line, and having at the other end thereof a compressed air circuit having an inlet for compressed air for forcing the composition out of the nozzle, and guidance means mounted beneath the body so as to guide the applicator nozzle and cause it to deliver composition accurately into the crease, characterised in that the applicator comprises valve means in the compressed air circuit and in that said guidance means is operatively connected to said valve means in the compressed air circuit such that when the guidance means contact the garment to be treated said valve means allows pressure to be applied to the composition and when the guidance means is removed from the garment to be treated said valve means allows pressure to be removed from the composition.

2. An applicator as claimed in claim 1 in which guidance means comprises a pair of rollers or wheels mounted on an axle so placed that, in use, they all straddle the crease to be treated.

3. An applicator as claimed in claim 1 in which the guidance means comprises a fin or blade mounted beneath the applicator so as to depend into the crease to be treated.

4. An applicator as claimed in any of claims 1 to 3 in which the guidance means comprise a block mounted for reciprocation within the applicator body, and said block constituting a portion of said valve means for controlling the supply of compressed air in response to movement of said block.

5. An applicator as claimed in claim 4 in which the valve controls a connection from the interior of the applicator body to a vent for compressed air.

6. An applicator as claimed in claim 1 in which said applicator body comprises a support block at said other end thereof and comprises a removable composition containing cartridge fitted on said support block.

7. An applicator as claimed in claim 6 further comprising a spigot movably positioned in said support block, said removable cartridge having a hole adjacent said spigot when the cartridge is received on said support block and said spigot being movable into said hole in response to pressure of compressed air from within the applicator to force said spigot from the support block into said hole in the cartridge whereby to retain the cartridge on the block.

* * * * *